US011827496B2

(12) United States Patent
Muller

(10) Patent No.: US 11,827,496 B2
(45) Date of Patent: Nov. 28, 2023

(54) LIFTING APPARATUS FOR HOISTING A GYRATORY CRUSHER SPIDER

(71) Applicant: FLSmidth A/S, Valby (DK)

(72) Inventor: Chris Muller, Perth (AU)

(73) Assignee: FLSmidth A/S

( * ) Notice: Subject to any disclaimer, the term of this patent is extended or adjusted under 35 U.S.C. 154(b) by 0 days.

(21) Appl. No.: 18/034,049

(22) PCT Filed: Jan. 25, 2022

(86) PCT No.: PCT/IB2022/050614

§ 371 (c)(1),
(2) Date: Apr. 26, 2023

(87) PCT Pub. No.: WO2022/157742

PCT Pub. Date: Jul. 28, 2022

(65) Prior Publication Data

US 2023/0322526 A1 Oct. 12, 2023

Related U.S. Application Data

(60) Provisional application No. 63/141,071, filed on Jan. 25, 2021.

(51) Int. Cl.
*B66C 1/28* (2006.01)
*B02C 23/00* (2006.01)

(52) U.S. Cl.
CPC ..... *B66C 1/28* (2013.01); *B02C 23/00* (2013.01)

(58) Field of Classification Search
CPC .... B66C 1/28; B66C 1/24; B66C 1/30; B66C 1/32

(Continued)

(56) References Cited

U.S. PATENT DOCUMENTS 2,987,339 A * 6/1961 Kaplan ..... B66C 1/24 294/81.5
4,542,928 A * 9/1985 Fowler, Jr. ..... B66C 1/16 294/81.1

(Continued)

FOREIGN PATENT DOCUMENTS

JP H0530067 U 4/1993

OTHER PUBLICATIONS

International Search Report and Written Opinion dated May 10, 2022, 13 pages.

(Continued)

*Primary Examiner* — Paul T Chin
(74) *Attorney, Agent, or Firm* — Jeffrey A. Sharp

(57) ABSTRACT

A lifting apparatus (100) for hoisting a spider (200) of a gyratory crusher has a spreader (110) spanning between two leg members (120) each having an offset arm (121*a*), clearing arm (121*b*), cradle arm (121*c*), and securing arm (121*d*). The offset arm (121*a*) forms a second offset distance (131) with respect to an offset axis (C). The arms (121*a*-121*d*) form an opening (123) for receiving the spider (200). The leg members (120) oppose each other such that the clearing arms (121*b*) of the leg members (120) are provided on opposite sides of a plane defined by the horizontal axis (D) and vertical axis (A). The lifting apparatus (100) may be lowered over the spider (200), and rotated approximately 90 degrees in a direction (B) of rotation about the vertical axis (A) to cradle and support the spider (200) from below the spider (200).

19 Claims, 8 Drawing Sheets

(58) Field of Classification Search
USPC ..... 294/67.2, 67.3
See application file for complete search history.

(56) References Cited

U.S. PATENT DOCUMENTS

| | | | | | |
|---|---|---|---|---|---|
| 4,671,724 | A * | 6/1987 | Bolton | B66C 1/64 | 414/10 |
| 4,722,106 | A * | 2/1988 | Scegiel | A01K 55/00 | D34/33 |
| 4,810,016 | A * | 3/1989 | Greenhow | B66C 1/24 | 294/67.21 |
| 4,919,465 | A * | 4/1990 | Gembarosky | B66C 1/24 | 267/140 |
| 5,476,300 | A * | 12/1995 | Dodge | B66C 1/54 | 294/93 |
| 5,688,010 | A * | 11/1997 | Moyer | B66C 1/24 | 294/67.2 |
| 6,007,125 | A * | 12/1999 | Merel | B66C 1/12 | 294/81.4 |
| 6,062,620 | A * | 5/2000 | Walker | B66C 1/10 | 294/67.5 |
| 7,059,644 | B2 * | 6/2006 | Neufeldt | B66C 1/48 | 294/102.1 |
| 7,134,701 | B1 | 11/2006 | Ronning | | |
| 11,085,194 | B2 * | 8/2021 | Boyd | E04G 21/14 | |
| 2011/0254302 | A1 * | 10/2011 | Imlach | B66C 13/02 | 294/119 |

OTHER PUBLICATIONS

Safer Faster Smarter Gyratory Crusher Maintenance, Sep. 19, 2019, 8 pages.

* cited by examiner

LIFTING APPARATUS FOR HOISTING A GYRATORY CRUSHER SPIDER

FIELD OF THE INVENTION

The present invention relates to a unique lifting apparatus for use within the crushing arts, in particular, for hoisting a spider of a gyratory crusher. The lifting apparatus is advantageous in that it may be utilized in tight spaces and engage a spider from a location directly above the spider, due to its unique "quarter-turn" engagement and disengagement functionality.

BACKGROUND TO THE INVENTION

Reference to background art herein is not to be construed as an admission that such art constitutes common general knowledge in the arts.

Conventional methods for lifting a spider of a gyratory crusher may typically involve welding lift eyes onto upper ends of a spider, casting loops into portions of the spider, threading lifting eye-bolts into upper surfaces of a spider, or incorporating transverse lifting bars within recessed cavities extending into upper surfaces of a spider. In this regard, lifting hooks attached to tensile members such as straps, wire rope, chains, or other top-rigging can be attached to the spider. Traditional slings can also be positioned below and around the spider and coupled to a hoist or crane. Such prior systems introduce unnecessary cost and complexity into spider designs. Moreover, it can be difficult, time-consuming, and dangerous for operators to secure rigging to multiple lift points, as it generally requires the presence of personnel within or near a dump pocket of a gyratory crusher.

Some spider hook designs, such as those currently offered by Tri-Star Design & Manufacturing Inc., aim to lift entire spider assemblies from a gyratory crusher without placing a person in the dump pocket of the gyratory crusher. This admittedly increases safety and efficiency, but such designs must necessarily approach and engage a spider from only one side of the spider. For smaller crushers, and/or where space is tight, there may not be enough side clearance within the gyratory crusher's feed opening (or throat) to slide a C-shaped hook under the spider from one side of the spider.

The present invention aims to improve upon existing spider lifting devices by incorporating an approximately 90-degree or "quarter-turn" hook design that can be lowered directly over top of a spider, without needing to place people in or directly adjacent to the dump pocket of a gyratory crusher. It is thus envisaged such embodiments may improve maintenance safety and efficiency, reduce installation/removal times, and facilitate installation/removal of a spider even within tight spaces or where small clearances might pose a concern for traditional single side-approach devices.

OBJECTS OF THE INVENTION

It is an aim of embodiments of the invention to provide an improved lifting apparatus (100) for raising and lowering a spider (200) of a gyratory crusher.

A particular aim is to provide a lifting apparatus (100) which overcomes or ameliorates one or more of the disadvantages or problems described above; or, which at least provides a useful alternative to conventional spider lifting apparatus.

For example, it is desired that lifting apparatus (100) embodiments provide a convenient way to suspend (i.e., raise, lower, lift, carry) a spider (200) in tight spaces. More specifically, it is desired to provide a lifting apparatus (100) can engage and/or disengage a spider (200) from directly above the center region of a spider (200), rather than scooping a spider from only one side of its sides.

Lastly, it is desired to provide a lifting apparatus (100) which makes it possible to remove and install a spider (200) without necessarily requiring complex lifting features (such as hook eyes) to be provided to portions of the spider (200).

Other preferred objects of the present invention will become apparent from the following description.

SUMMARY OF INVENTION

Embodiments of a lifting apparatus (100) for hoisting a spider (200) of a gyratory crusher are disclosed.

The lifting apparatus (100) may comprise a spreader (110). The spreader (110) may have a tether receiving portion (113) for receiving and/or connecting to a tensile member. The tensile member (not shown) may be operably connected to a hoist, crane, lift, or the like for raising and lowering the lifting apparatus (100). The tensile member may, for example, comprise a component of a cable winch, crane, lift, hoist, chain, rope, or the like, without limitation.

The spreader (110) may extend along a horizontal axis (D) and span between two opposed leg members (120). Each of the leg members (120) may extend downwardly from the spreader (110). The leg members (120) may be spaced from one another by a first offset distance (130) from a vertical axis (A) of the lifting apparatus (100).

The lifting apparatus (100) may be characterised in that each of the leg members (120) may comprise an offset arm (121*a*), a clearing arm (121*b*) extending downwardly from the offset arm (121*a*), a cradle arm (121*c*), and a securing arm (121*d*) extending upwardly from the cradle arm (121*c*) as depicted. The cradle arm (121*c*) may bridge a lower portion of the clearing arm (121*b*) to a lower portion of the securing arm (121*d*). The offset arm (121*a*) may form a second offset distance (131) with respect to an offset axis (C) that is both substantially orthogonal to the horizontal axis (D) and substantially parallel to the vertical axis (A). The securing arm (121*d*) may form a third offset distance (132) with respect to the same offset axis (C), without limitation.

The offset arm (121*a*), clearing arm (121*b*), cradle arm (121*c*), and securing arm (121*d*) may collectively form an opening (123) for receiving the spider (200). In other words, the spider (200) may, as depicted in FIG. 1, rest transversely through an opening (123) of each leg member (120).

The leg members (120) may oppose each other by facing in opposite directions as clearly depicted in the drawings. Thus, the leg members (120) may be oriented such that the clearing arms (121*b*) of the leg members (120) are provided on opposite sides of a plane defined by the horizontal axis (D) and vertical axis (A). In this regard, the lifting apparatus (100) may be lowered over and around the spider (200) from above the spider (200). Once the clearing arms (121*b*) have sufficiently straddled the spider (200), the lifting apparatus (100) may be rotated approximately 90 degrees in a direction (B) of rotation about the vertical axis (A) to cradle the spider (200) from below the spider (200) and support the spider (200). Accordingly, the spider (200) may be supported by the lifting apparatus (100) at a support surface (127) atop each cradle arm (121*c*).

In some embodiments, rotation about vertical axis (A) in direction (B) may be imparted using one or more tether lines (not shown) extending from the lifting apparatus (100). For example, two tether lines may extend to two crew members located away from and on opposing sides of the spider (200) (e.g., on opposite sides of a gyratory crusher). The crew members may walk the lifting apparatus (100) into locked or released alignment with respect to spider (200) by virtue of walking the tethers around the spider (200) in a clockwise or counter-clockwise direction as required. While not shown, such tether lines may be attached to a portion of leg members (120), such as at one of the arms (121*a*-121*d*). Such tether lines may also be attached to either or both ends of the lower body (111), for example, using dedicated lashing points, without limitation.

In some embodiments, the lifting apparatus (100) may comprise an extension flange (122) running a length of the offset arm (121*a*), the clearing arm (121*b*), the cradle arm (121*c*), the securing arm (121*d*), or a combination thereof, without limitation. For example, the extension flange (122) may, as shown, run along all four arms (121*a*-121*d*), without limitation. The extension flange (122) may define a portion of support surface (127) and may serve to improve strength or torsional rigidity of the lifting apparatus (100).

In some embodiments, the spreader (110) of the lifting apparatus (100) may comprise a substantially planar upper body (112). In some embodiments, the spreader (110) may comprise a substantially tubular lower body (111).

An upper proximal end (126) portion of each leg member (120) may comprise an upper body receiving portion (128). The upper proximal end (126) portion of each leg member (120) may also comprise a lower body receiving portion (129). The upper (128) and lower (129) body receiving portions may be configured for receiving respective upper (112) and lower (111) body portions of the spreader (110), without limitations (refer to FIGS. 4 & 5). In some embodiments, the upper body receiving portion (128) may comprise a slot or slit. The lower body receiving portion (129) may comprise an aperture, without limitation. A lower portion of each of leg member (120) may comprise a skid (124).

In some embodiments, the leg members (120) may be substantially planar members. Thus, arms (121*a*-121*d*) may be substantially co-planar with one another, without limitation. The leg members (120) may have a generally "C"-shaped, slanted "J"-shaped, or "fishhook"-shaped profile as shown, without limitation. The leg members (120) may appear as opposing upside-down question marks, without limitation.

A lower distal end (125) of each of the leg members (120) may be provided on opposite sides of the plane defined by the horizontal axis (D) and vertical axis (A) as shown. Moreover, the securing arms (121*d*) of the leg members (120) may be provided on opposite sides of the plane defined by the horizontal axis (D) and vertical axis (A). The tether receiving portion (113) of the lifting apparatus (100) may comprise an aperture for receiving a cable, hook, rope, chain, link, or other tensile member, without limitation.

The spreader (110) may comprise an upper surface (114) having two angled edges which, together, form an apex (115). The apex (115) may be located adjacent the tether receiving portion (113) as shown, without limitation. The upper body (112) may comprise one or more stiffening ribs (not shown) for strength and/or torsional rigidity.

The leg members (120) may be attached to the spreader (110) in any conceivable fashion. However, as depicted, the lifting apparatus (110) may be assembled by moving the leg members (120) along the horizontal axis (D) adjacent the sides of the spreader (110), without limitation. The leg members (120) may be temporarily secured to the spreader (110) (e.g., via removable fasteners), or they may be permanently affixed to the spreader (110) (e.g., via welding), without limitation.

A method of lifting a spider (200) for a gyratory crusher is further disclosed. The method may comprise the step of providing a lifting apparatus (100) as described above. The method may involve the step of suspending the lifting apparatus (100) by a tether or other rigging above a spider (200) to be lifted. The method may further comprise the step of lowering the lifting apparatus (100) over the spider (200) so that the leg members (120) (in particular, the clearance arms (121*b*)) of the lifting apparatus (100) straddle side portions of the spider (200). The method may further comprise the step of turning the lifting apparatus (100) approximately 90 degrees in a direction (B) of rotation about the vertical axis (A), such that the lifting apparatus (100) cradles the spider (200) from below the spider (200) and supports the spider (200) at a support surface (127) atop each cradle arm (121*c*). The method may further comprise the step of lifting the spider (200) by raising the lifting apparatus (100) with the spider (200) received and secured within openings (123).

In some embodiments, the step of lifting the spider (200) by raising the lifting apparatus (100) comprises raising a tensile member (not shown) attached to the tether receiving portion (113) of the lifting apparatus (100).

In some embodiments, the method may comprise the step of removing the spider (100) from a gyratory crusher. In some embodiments, the method may comprise the step of lowering the spider (200) onto a gyratory crusher for securement thereto.

In some embodiments, each leg member (4,120) of the lifting apparatus (100) may comprise a fully boxed-frame structure. The fully-boxed-frame structure may be comprised of an inner plate (5), an outer plate (6), an extension flange (3) joining the inner plate (5) to the outer plate (6) along their respective edges, and a number of transverse stiffening/reinforcement plates extending between the inner plate (5) and the outer plate (6).

In some embodiments, a portion of the spreader (35, 110) of the lifting apparatus (100) may comprise forklift receiving members (37).

In some embodiments, the lifting apparatus (100) may further comprise one or more gussets (19) extending between the leg members (4,120) and the spreader (110).

In some embodiments, the lifting apparatus (100) may comprise a saddle (32) having a polymer structure (34) provided to the cradle arm (27, 121*c*) of each leg member (4, 120).

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures.

FIG. 1 shows the lifting apparatus (100) in a "rotated and locked" operational configuration. This configuration may be used for lifting or lowering the spider (200). Cradle arms (121*c*) are shown to be supporting bottom surfaces of the spider (200). To remove the lifting apparatus (100) from the spider (200), the lifting apparatus (100) may be rotated clockwise about vertical axis (A) in an opposite direction of rotation (B) and raised or lifted vertically away from spider (200) along vertical axis (A).

FIG. 4 shows particulars of a spreader (110) portion of the lifting apparatus (100), and FIG. 5 shows particulars of leg members (120) intended to be joined to the spreader (110) shown in FIG. 4.

DETAILED DESCRIPTION OF THE DRAWINGS

Figure 1:
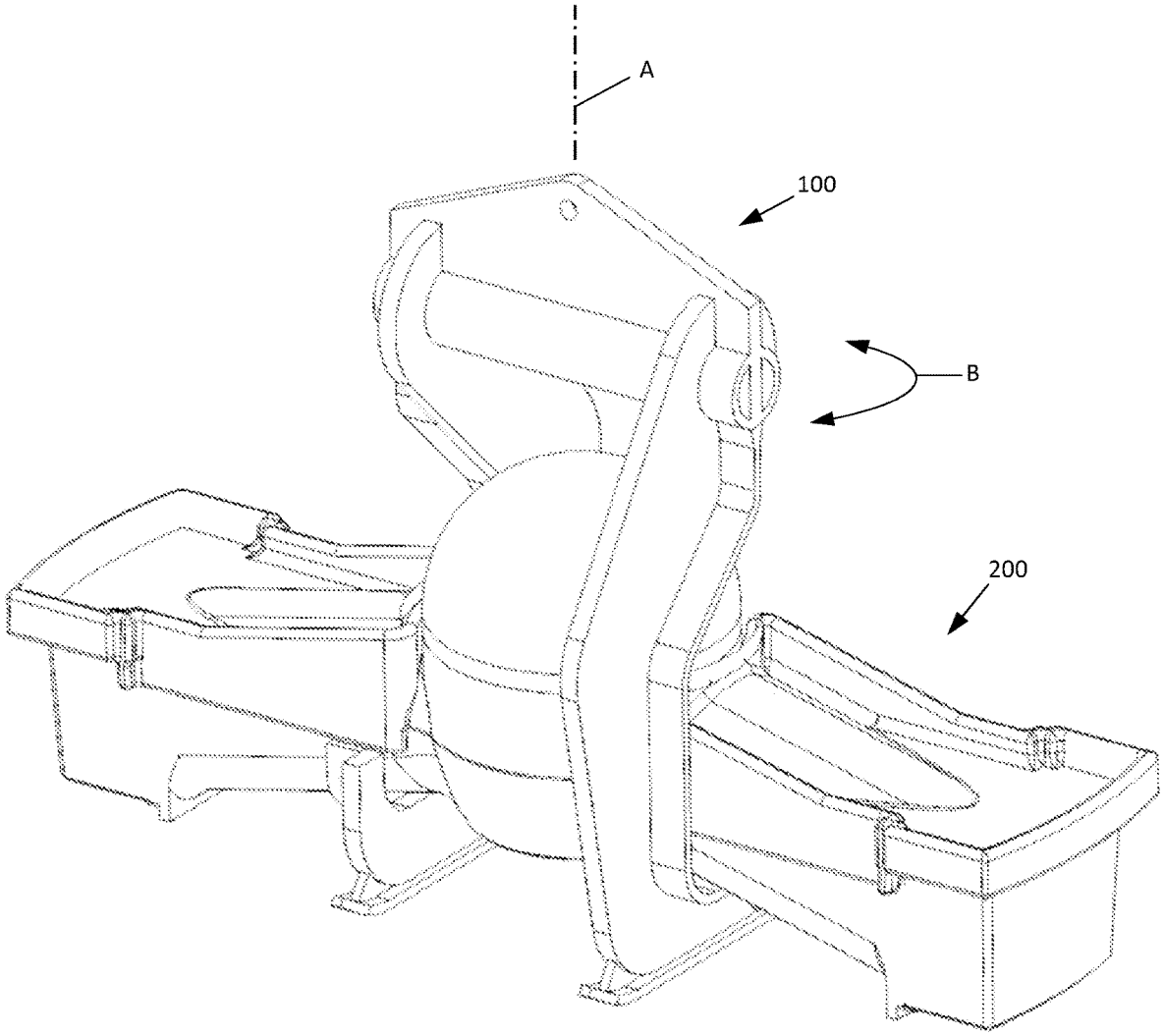
FIG. 1 is a representative perspective view illustrating an embodiment of a lifting apparatus (100) in accordance with the invention. The lifting apparatus (100) is shown to be engaging a spider (200) of a gyratory crusher. In particular.
Figure 2:
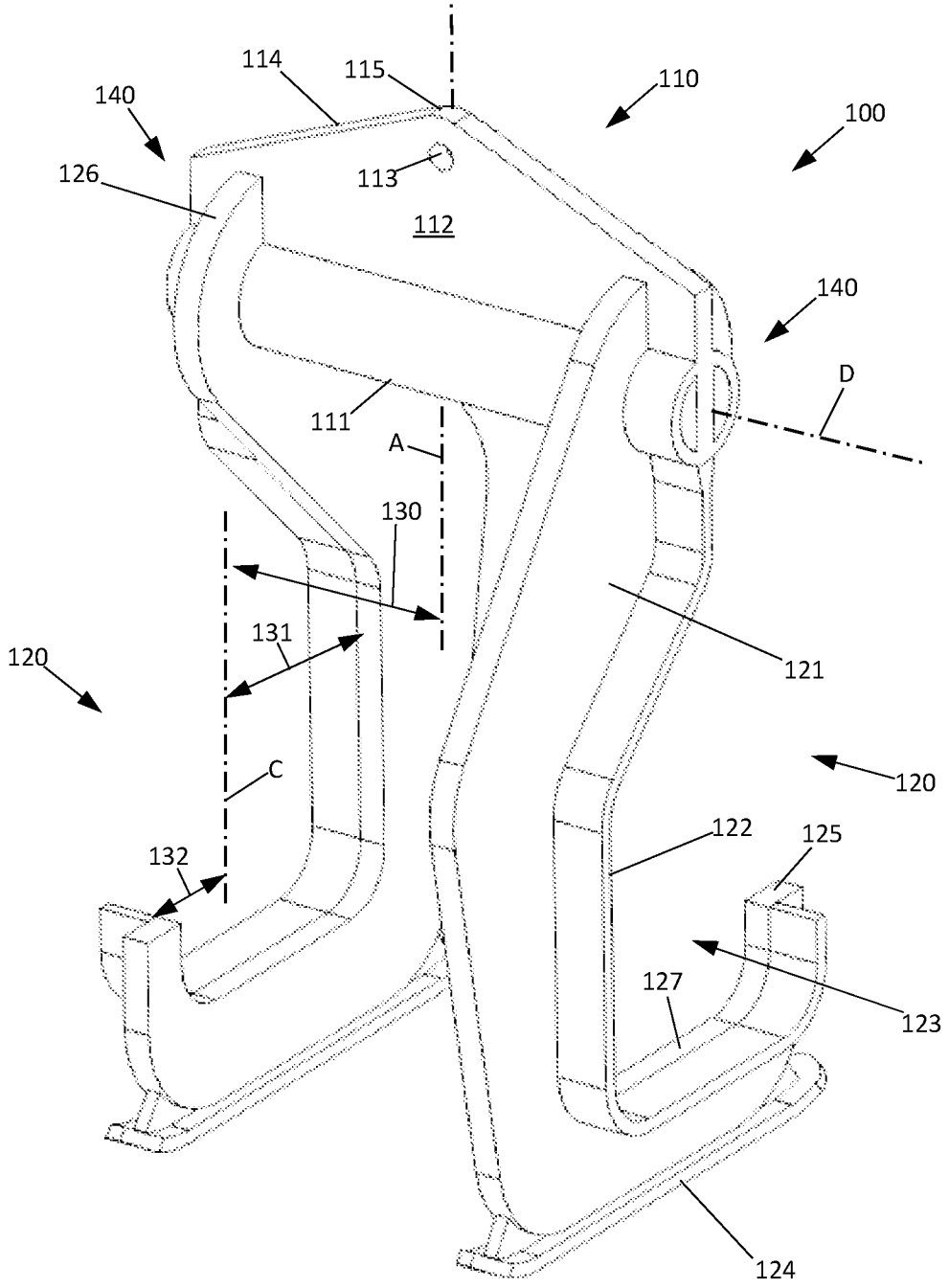
FIG. 2 shows a first isometric perspective view of the lifting apparatus (100) depicted in FIG. 1.
Figure 3:
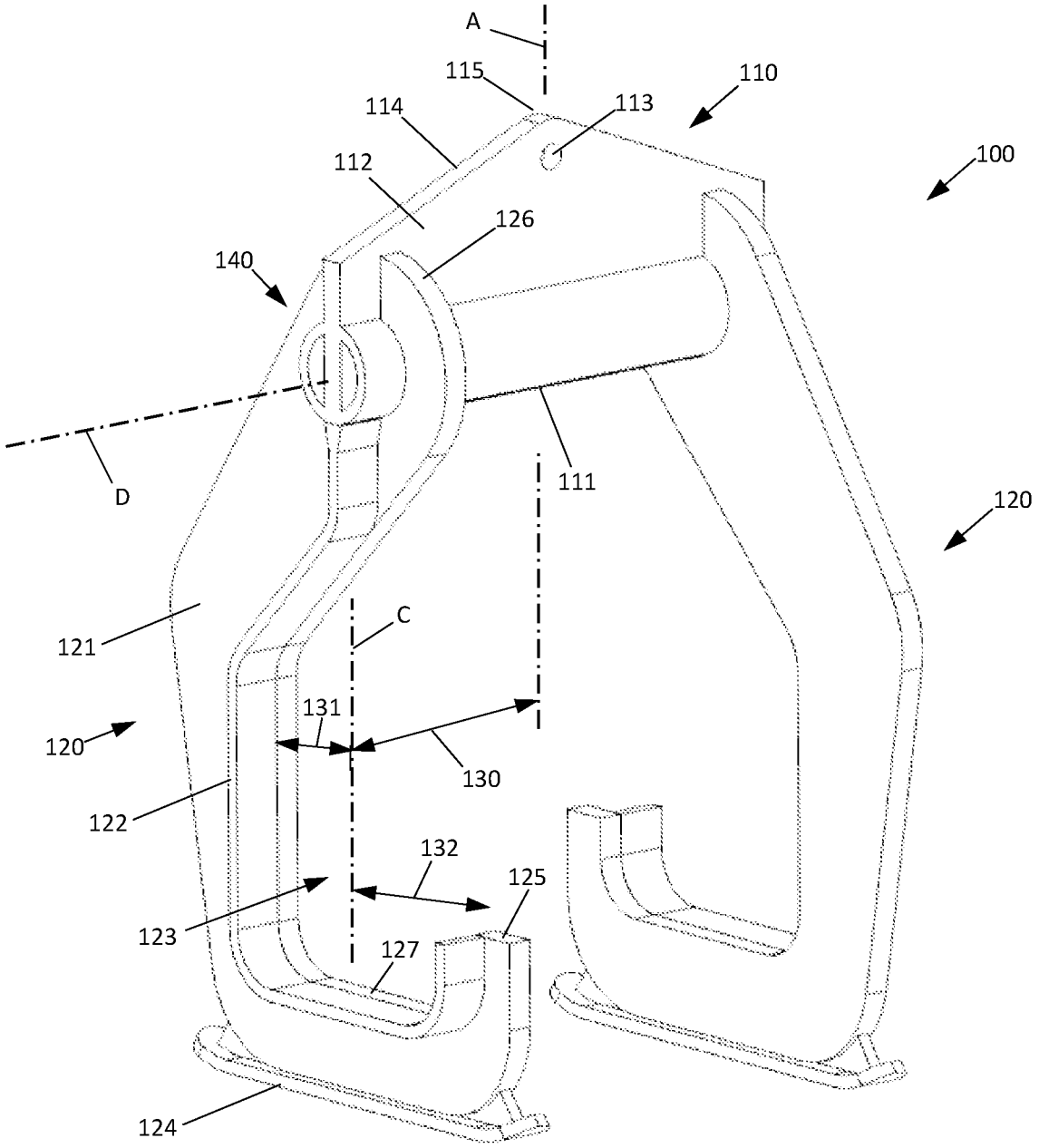
FIG. 3 shows a second isometric perspective view of the lifting apparatus (100) depicted in FIGS. 1 & 2.
Figure 4:
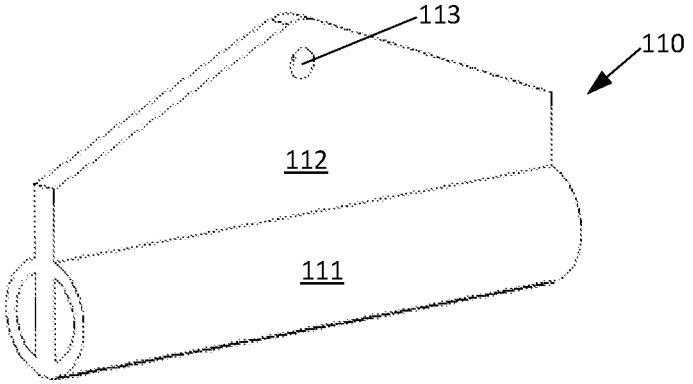
FIGS. 4 and 5 collectively show an exploded view of the lifting apparatus (100) depicted in FIGS. 1-3.
Figure 5:
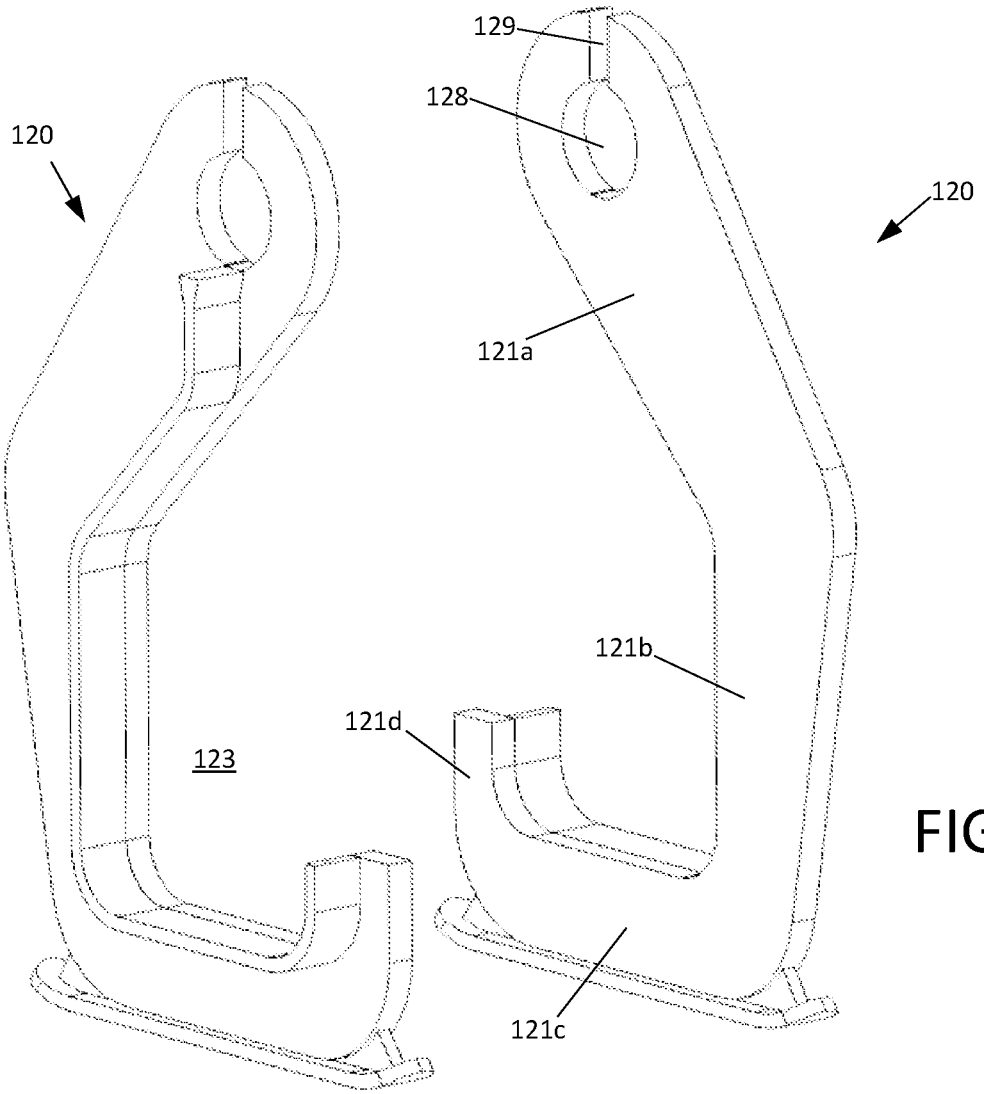
Figure 6:
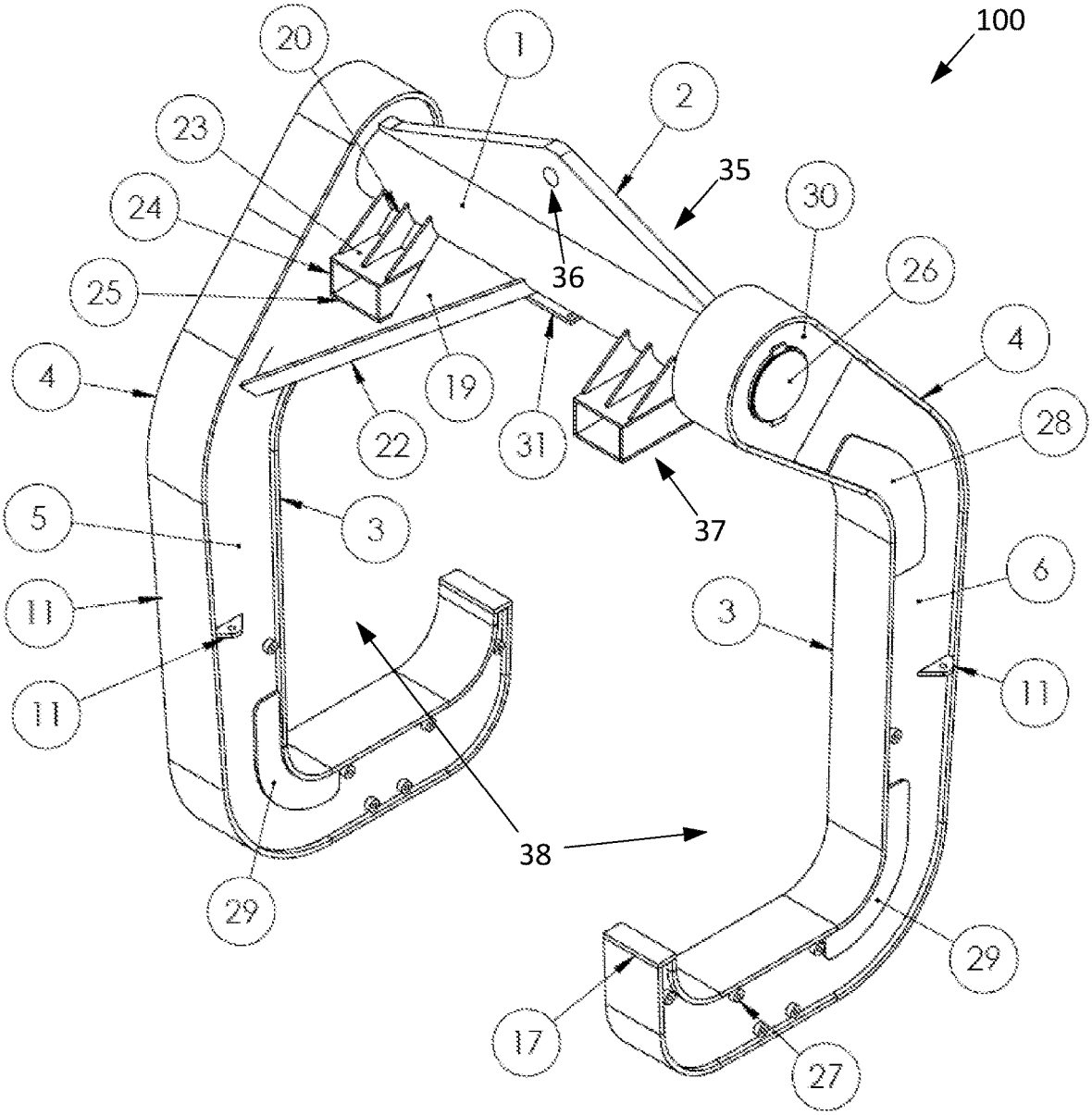
FIG. 6 depicts an isometric view of another non-limiting embodiment of a lifting apparatus (100) in accordance with the invention.
Figure 7:
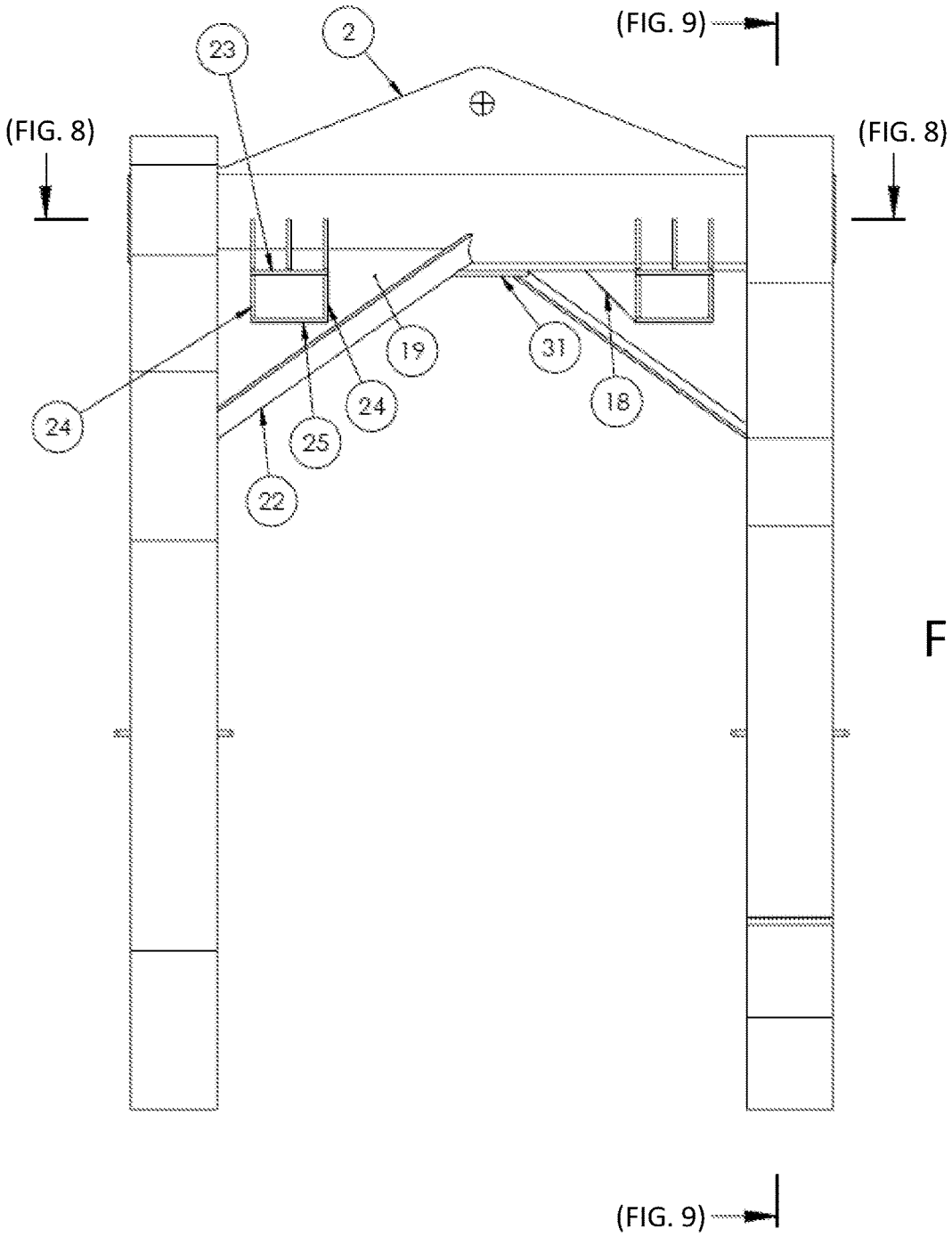
FIG. 7 is a front side plan view of the lifting apparatus (100) depicted in FIG. 6.
Figure 8:
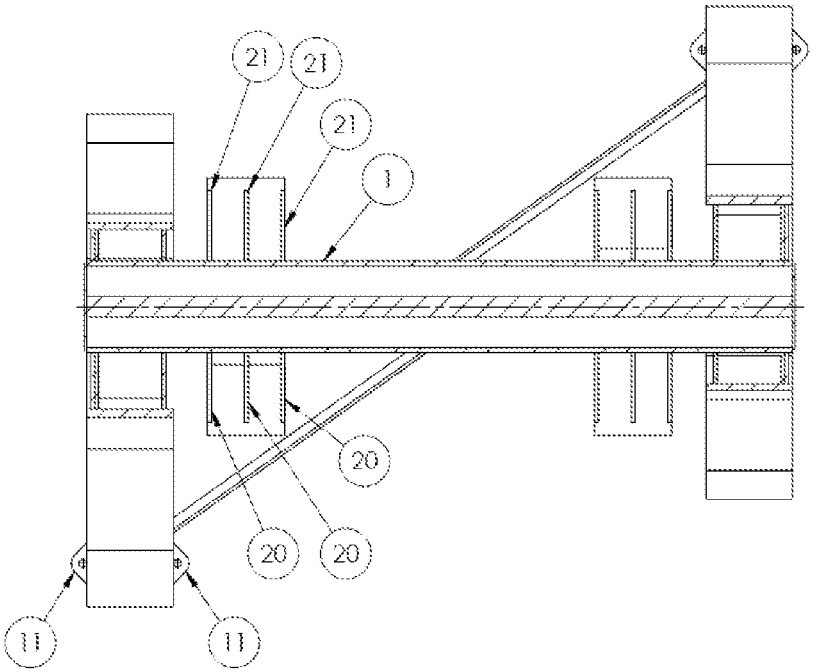
FIG. 8 is a partial cutaway top view of the lifting apparatus (100) depicted FIGS. 6 & 7—along the representative plane shown in FIG. 7.
Figure 9:
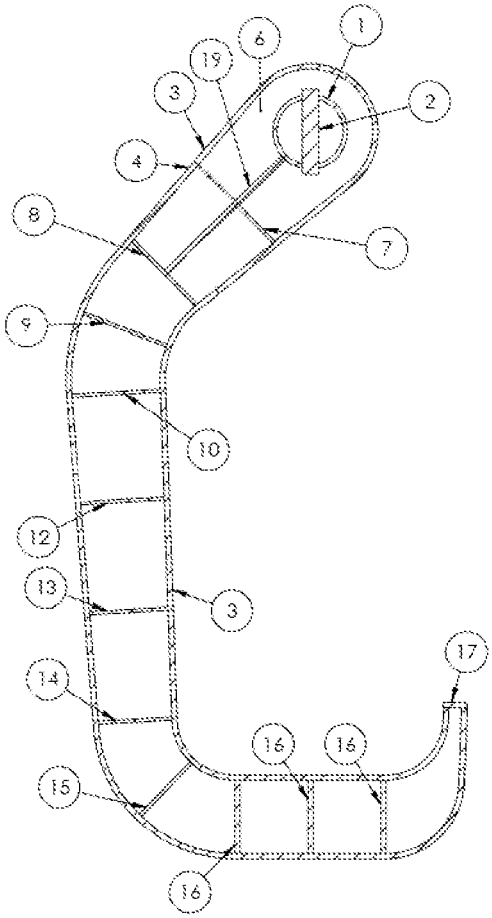
FIG. 9 is a partial cutaway side view of the lifting apparatus (100) depicted FIGS. 6-8—along the representative plane shown in FIG. 7.
Figure 10:
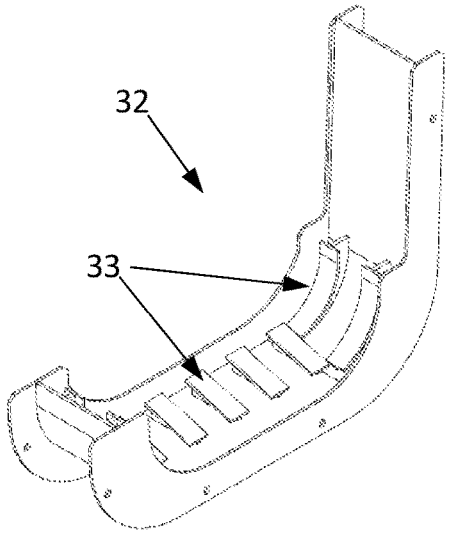
FIG. 10 depicts a frame portion of a saddle (32) having one or more over-mould retaining features (33) which may be provided over a cradle arm (27) of the lifting apparatus (100) according to some non-limiting embodiments.

As shown in FIG. 1, a lifting apparatus 100 (i.e., "spider hook") may be lowered directly over a central portion of a spider 200 and rotated approximately 90 degrees (or a "quarter turn") about a vertical axis A, and in a direction of rotation B, to cradle and support a spider 200. Once supported, the spider 200 may be lifted (i.e., raised, lowered, or suspended) using the lifting apparatus 100.

While not shown, rigging is to be used in conjunction with lifting apparatus 100. The rigging used in conjunction with the lifting apparatus 100 may include any suitable rigging known in the art including, but not limited to tethers, ropes, webbing, straps, chains, cables, buckles, hooks, slings, and the like. The rigging may be operably connected to the lifting apparatus 100, for example, via a tether receiving portion 113. The tether receiving portion 113, in its simplest form, may comprise an aperture or lift eye for receiving a lifting hook at an end of a tensile member.

The lifting apparatus 100 may rotate about a vertical axis A in a direction of rotation B, whilst being connected to the rigging. A spreader 110 portion of the lifting apparatus may extend along a horizontal axis D, and span between upper proximal ends 126 of two leg members 120. The two leg members 120 may each comprise their own offset axis C. Each offset axis C may comprise a vertical axis that substantially parallel with vertical axis A and separated from the vertical axis A by a first offset distance 130 along the horizontal axis D, as shown. The horizontal axis D may, as shown, extend transversely with respect to, and/or orthogonally in relation to vertical axis A, without limitation.

Spreader 110 may be comprised of an upper body 112 portion and a lower body 111 portion. The upper body 112 may comprise a planar member or be formed from a plate as shown in the non-limiting embodiment of the figures. The lower body 111 may comprise a tubular portion, which can be hollow or solid (e.g., cylindrical), without limitation. The tether receiving portion 113 may comprise an aperture extending through an upper portion of upper body 112, a welded lift eye, or other means for connecting the lifting apparatus 100 to the aforementioned rigging, without limitation. The tether receiving portion 113 may be located adjacent an upper surface 114 of the upper body 112 of the spreader 110. It is envisaged that a plurality of tether receiving portions 113 may be provided to the spreader 110, for example, in a V-shaped bridal hitch configuration, rather than a vertical hitch configuration, without limitation. The upper surface 114 may take on any preferable shape, but in some preferred embodiments, as depicted, the upper surface 114 may be formed of two angled surfaces which meet to form an apex 115 adjacent the tether receiving portion 113, without limitation.

Leg members 120 may extend downwardly from side ends of the spreader 110, e.g., at connections 140. Connections 140 between the leg members 120 and the spreader 110 may be temporary (e.g., via the use of fasteners) or permanent (e.g., via welding or casting). In the particular embodiment shown, each leg member 120 may comprise an upper body receiving portion 128 (e.g., an aperture) and a lower body receiving portion 129 (e.g., slit, slot) at its upper proximal end 126. The receiving portions 128, 129 may slide onto ends of spreader 110 along a direction aligned with horizontal axis D, and towards vertical axis A, without limitation. Other forms and configurations for connections 140 may be practiced.

According to some embodiments, leg members 120 may be substantially planar members. They may be inexpensively formed from plate 121 or casted in a manner which provides sufficient strength. Each leg member 120 may comprise an offset arm 121*a* extending downwardly and away from the spreader 110 and away from the horizontal axis D, a clearing arm 121*b* extending downwardly from the offset arm 121, a cradle arm 121*c* extending from the clearing arm 121*b* and under the spreader 110, and a securing arm 121*d* extending upwardly from the cradle arm 121*c* and ending at a lower distal end 125. Collectively, the offset arm 121*a*, clearing arm 121*b*, cradle arm 121*c*, and securing arm 121*d* may form an opening 123 which is configured to receive the spider 200. As depicted in FIG. 1, the spider 200 may rest transversely within the openings 123.

The clearing arm 121*b* of each leg member 120 may be offset from its respective offset axis C by a second offset distance 131 which may be substantially perpendicular to first offset distance 130. The securing arm 121*d* of each leg member 120 may be offset from its respective offset axis C by a third offset distance 132 which may also be substantially perpendicular to first offset distance 130, without limitation.

An upper portion of the cradle arm 121*c* may include a support surface 127 for engaging and supporting one or more lower surfaces of a spider 200. The support surface 127 may optionally be configured with a shape or profile which is complimentary to a similar shape or profile of the underside of the spider 200, without limitation. As shown, support surface 127 may be flat.

The support surface 127 and/or or portions of other arms 121*a*-121*d* may be widened with an optional extension flange 122. The extension flange 122 may serve to distribute loads (e.g., as a stiffening member) and/or increase strength and torsional rigidity of the lifting apparatus 100. The extension flange 122 may also serve to spread out point loads at contact points between leg members 120 and the spider 200. In addition to, or in lieu of extension flange 122, each leg member 120 may comprise a skid 124 at its lower end, without limitation. Support surface 127 may be treated with surface texture or a soft material to improve friction between the lifting apparatus 100 and spider, without limitation.

Turning now to FIGS. 6-13, embodiments of a lifting apparatus 100 may comprise a spreader 35 supporting two leg members 4 at each end thereof. The leg members 4 may be secured to a lower body 1 of the spreader 35 by a securing device 26 (e.g., a pinned or welded endcap or flange) as shown. The lower body 1 may be coupled to an upper body 2 provided with a tether receiving portion 36. The tether receiving portion 36 may comprise an aperture extending through the upper body 2, a welded lift eye, or other means for connecting the lifting apparatus 100 to rigging for a hoist, crane, lift, or the like, without limitation. As with the embodiment of FIGS. 1-5, the upper body 2 may be planar, and the lower body 1 may be tubular to reduce weight.

Each leg member 4 may be provided in the form of "C-hooks", and may have a fully-boxed frame structure comprised of an inner plate 5, an outer plate 6, and one or more transverse stiffening/reinforcement plates 7, 8, 9, 10, 12, 13, 14, 15, 16 extending therebetween. For example, as shown, a plurality of transverse stiffening/reinforcement plates 7, 8, 9, 10, 12, 13, 14, 15, 16 may be provided along the profile of each leg member at discrete distance intervals as most clearly seen in FIG. 9. An extension flange 3 may join the inner 5 and outer 6 plates together along their peripheral edges and cap/enclose each leg member 4 to form a fully-boxed frame structure as shown.

Similar to the embodiment described above in reference to FIGS. 1-5, each leg member 4 may be provided with an upper offset arm 30 obliquely-extending from the lower body 1 to a substantially-vertically-extending clearing arm 11, a lower cradle arm 27 extending substantially perpendicular from the clearing arm 11, and a distal securing arm 17 rising upwardly from the cantilevered end of the cradle arm 27 and configured to secure a spider 200 cradled within the lifting apparatus 100. The leg members 4 are positioned so as to have their open sides (i.e., openings 38) oriented in oppositely-facing directions as depicted.

Forklift receiving members 37 may be provided to portions of the lifting apparatus 100. For example, as shown, two forklift receiving members 37 may be provided to a portion of the spreader 35, such as to the lower body 1. Each forklift receiving member 37 may comprise a rectangular tubular member having an upper surface 23, two side surfaces 24, and a lower surface 25. Each forklift receiving member 37 may be secured to a portion of the lower body 1, for example, by one or more upper front 20 and upper back 21 support plates without limitation. In addition to, or as an alternative to the aforementioned, each forklift receiving member 37 may be secured to the lower body 1 by one or more side support plates 18, without limitation. The plates 18, 20, 21, are preferably triangular and preferably extend perpendicularly to surfaces 23, 24, 25 of the forklift receiving members 37, without limitation. It should be understood that portions of the upper plates 20, 21 may extend between an undersurface of the lower body 1 and an upper surface 23 of a forklift receiving member 37.

Leg member gussets 19 may obliquely extend between the lower body 1 and an inner 5 plate of each leg member to improve strength and torsional rigidity of the lifting apparatus 100. An edge of these gussets 19 may be provided with a stiffening flange 22 to form a partial I-beam structure for additional strength.

One or more upper stiffening plates 28 and/or one or more lower stiffening plates 29 may also be provided to inner 5 or outer 6 plates of each leg member, particularly at the curved junction between the offset arm 30 and clearing arm 11, and junction between the offset arm 30 and cradle arm 27, without limitation.

Figure 12:
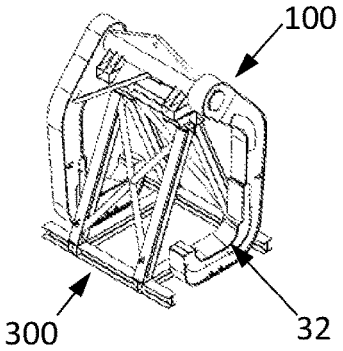
FIG. 12 shows a first configuration of a lifting apparatus (100) resting on an optional support chassis (300) awaiting securement to a hoist or crane—or transport by a fork lift.
Figure 13:
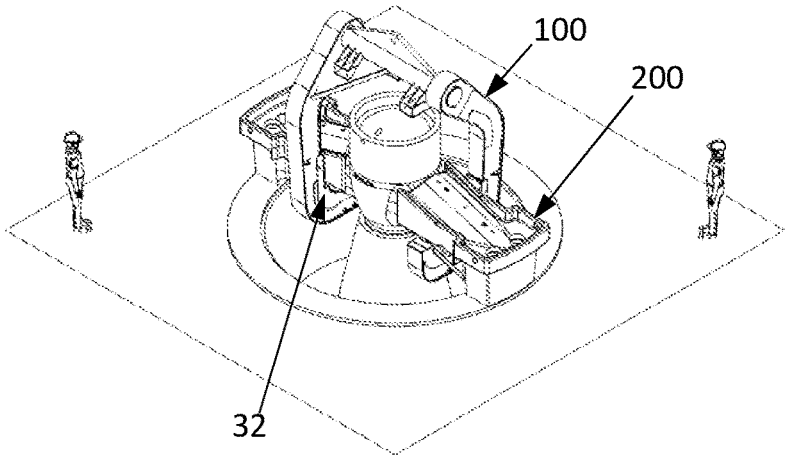
FIG. 13 shows a second configuration of a lifting apparatus (100) engaging a spider (200) for lowering or raising the same, wherein a tensile member of a hoist or crane is not shown to be coupled to the tether receiving portion (36) of the lifting apparatus (100) for clarity.

Optionally, a bottom plate 31 may be provided to the lower body 1 of the spreader to allow for additional rigging, protect the lower body 1 from impact or damage, and/or to serve as a resting or "bottom-out" surface. Such a bottom plate 31 may, for example, find practical use in centering or self-aligning the lifting apparatus 100 with an underlying support chassis 300 (FIG. 12).

Figure 11:
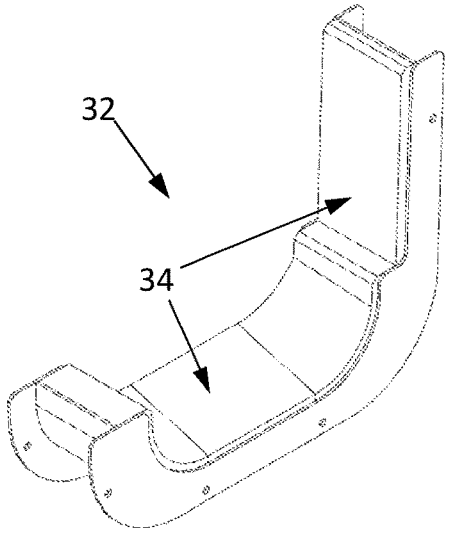
FIG. 11 depicts the saddle (32) of FIG. 10 having its frame portion over-moulded with a polymer structure (34) such as urethane or rubber.

Turning now to FIGS. 10-13, a saddle 32 may be provided to an upper portion of the cradle arm 27 of each leg member 4. The saddle 32 may comprise a frame portion (FIG. 10) having one or more integral over-mould retaining features 33 on its upper side as depicted. Each over-mould retaining feature 33 preferably has an overhang or undercut feature which is configured to retain an over-moulded polymeric substrate. For example, as depicted in FIG. 11, a polymer structure 34 (e.g., an over-mould layer of urethane or rubber) may be formed over the frame to provide adequate protection to the cradle arms 27 and spider 200, as well as provide better gripping and conforming with the undersurface of spider 200.

In this specification, adjectives such as first and second, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc. When describing methods and steps thereof, the order or appearance of a listed step may not be important. Thus, it is possible for method steps to be taken out of sequence from what is described.

The above description of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the spirit and scope of the above described invention.

In this specification, the terms 'comprises', 'comprising', 'includes', 'including', "has", "having", "incorporates", "is provided with", or similar terms are intended to mean a non-exclusive inclusion, such that a method, system or apparatus that comprises a list of elements does not include those elements solely, but may well include other elements not listed. It should further be understood that embodiments described and/or depicted herein are provided for exemplary purposes only, and that certain elements, features, components, or steps described and/or depicted may be optionally omitted, replaced with art-recognized equivalents, or combined in any logical permutation consistent with the aims of the inventive concept.

LIST OF REFERENCE IDENTIFIERS

1 Lower body (e.g., tubular portion, pipe, bar)
2 Upper body (e.g., plate)
3 Extension flange
4 Leg member (e.g., C-hooks)
5 Inner plate
6 Outer plate
7 Transverse stiffening/reinforcement plate
8 Transverse stiffening/reinforcement plate
9 Transverse stiffening/reinforcement plate
10 Transverse stiffening/reinforcement plate
11 Clearing arm
12 Transverse stiffening/reinforcement plate
13 Transverse stiffening/reinforcement plate
14 Transverse stiffening/reinforcement plate
15 Transverse stiffening/reinforcement plate
16 Transverse stiffening/reinforcement plate
17 Securing arm
18 Side support plate—Forklift receiving member
19 Gusset
20 Upper front support plate(s)—Forklift receiving member
21 Upper back support plate(s)—Forklift receiving member
22 Stiffening flange
23 Upper surface—Forklift receiving member
24 Side surface(s)—Forklift receiving member
25 Lower surface—Forklift receiving member
26 Securing device (e.g., endcap)
27 Cradle arm
28 Upper stiffening plate
29 Lower stiffening plate
30 Offset arm
31 Bottom plate (of lower body 1)
32 Saddle
33 Over-mould retaining feature(s)
34 Polymer structure (e.g., over-mould layer of urethane or rubber)
35 Spreader
36 Tether receiving portion
37 Forklift receiving member(s)
38 Opening
A Vertical axis
B Direction of rotation
C Offset axis
D Horizontal axis (e.g., transverse or orthogonal to vertical axis A)
100 Lifting apparatus (e.g., "spider hook")
110 Spreader
111 Lower body (e.g., tubular portion, pipe, bar)
112 Upper body (e.g., plate)
113 Tether receiving portion
114 Upper surface (e.g., angled)
115 Apex
120 Leg member (e.g., C-hooks)
121 Plate
121*a* Offset arm
121*b* Clearing arm
121*c* Cradle arm
121*d* Securing arm
122 Extension flange
123 Opening
124 Skid
125 Lower distal end
126 Upper proximal end
127 Support surface
128 Upper body receiving portion (e.g., aperture)
129 Lower body receiving portion (e.g., slot)
130 First offset distance (i.e., between axes A & C)
131 Second offset distance (between vertical axis C and clearing arm 121*b*)
132 Third offset distance (i.e., between offset axis C and securing arm 125)
140 Connection
200 Spider of a gyratory crusher
300 Support chassis

What is claimed is:

1. A lifting apparatus (100) for hoisting a spider (200) of a gyratory crusher, the lifting apparatus (100) comprising a spreader (35,110) having a tether receiving portion (36,113); the spreader (35,110) extending along a horizontal axis (D) and spanning between two leg members (4,120); each of the leg members (4,120) extending downwardly from the spreader (110) and being spaced from one another by a first offset distance (130) from a vertical axis (A) of the lifting apparatus (100), the lifting apparatus (100) being CHARACTERISED IN THAT each of the leg members (4,120) comprises an offset arm (30,121*a*), a clearing arm (121*b*) extending downwardly from the offset arm (30,121*a*), a cradle arm (27,121*c*), and a securing arm (17,121*d*) extending upwardly from the cradle arm (27,121*c*); the cradle arm (121*c*) bridging a lower portion of the clearing arm (11, 121*b*) to a lower portion of the securing arm (17,121*d*), the offset arm (30,121*a*) forming a second offset distance (131) with respect to an offset axis (C) that is both substantially orthogonal to the horizontal axis (D) and substantially parallel to the vertical axis (A);

wherein the offset arm (30,121*a*), clearing arm (11,121*b*), cradle arm (27,121*c*), and securing arm (17,121*d*) form an opening (38,123) for receiving the spider (200); and, wherein the leg members (4,120) are oriented such that the clearing arms (11,121*b*) of the leg members (4,120) are provided on opposite sides of a plane defined by the horizontal axis (D) and vertical axis (A), such that the lifting apparatus (100) may be lowered over and around the spider (200) from above the spider (200), and such that the lifting apparatus (100) may be rotated approximately 90 degrees in a direction (B) of rotation about the vertical axis (A) to cradle the spider (200) from below the spider (200) and support the spider (200) at a support surface (34,127) atop each cradle arm (27, 121*c*).

2. The lifting apparatus (100) according to claim 1, further comprising an extension flange (3,122) running a length of the offset arm (30,121*a*), clearing arm (11,121*b*), cradle arm (27,121*c*), securing arm (17,121*d*), or a combination thereof.

3. The lifting apparatus (100) according to any one of the preceding claims, wherein the spreader (35,110) comprises a substantially planar upper body (2,112).

4. The lifting apparatus (100) according to any one of the preceding claims, wherein the spreader (35,110) comprises a substantially tubular lower body (1,111).

5. The lifting apparatus (100) according to any one of the preceding claims, wherein each leg member (4,120) comprises a fully boxed-frame structure having an inner plate (5), an outer plate (6), an extension flange (3) joining the inner plate (5) to the outer plate (6) along their respective edges, and a number of transverse stiffening/reinforcement plates extending between the inner plate (5) and the outer plate (6).

6. The lifting apparatus (100) according to any one of the preceding claims, wherein a portion of the spreader (35, 110) comprises forklift receiving members (37).

7. The lifting apparatus (100) according to any one of the preceding claims, wherein a lower portion of each of the leg members (4,120) comprises a skid (124).

8. The lifting apparatus (100) according to any one of the preceding claims, wherein the leg members (4,120) are substantially planar.

9. The lifting apparatus (100) according to any one of the preceding claims, wherein the leg members (4,120) have a "C"-shaped, slanted "J"-shaped, or "fishhook"-shaped profile.

10. The lifting apparatus (100) according to any one of the preceding claims, wherein a lower distal end (125) of each of the leg members (4,120) are provided on opposite sides of the plane defined by the horizontal axis (D) and vertical axis (A).

11. The lifting apparatus (100) according to any one of the preceding claims, wherein the securing arms (17,121*d*) of the leg members (4,120) are provided on opposite sides of the plane defined by the horizontal axis (D) and vertical axis (A).

12. The lifting apparatus (100) according to any one of the preceding claims, wherein the tether receiving portion (36, 113) comprises an aperture for receiving a cable, hook, rope, chain, link, or other tensile member.

13. The lifting apparatus (100) according to any one of the preceding claims, wherein the spreader (35,110) comprises an upper surface (114) having two angled edges which together form an apex (115) adjacent the tether receiving portion (113).

14. The lifting apparatus (100) according to any one of the preceding claims, further comprising one or more gussets (19) extending between the leg members (4,120) and the spreader (110).

15. The lifting apparatus (100) according to any one of the preceding claims, further comprising a saddle (32) having a polymer structure (34) provided to the cradle arm (27, 121*c*) of each leg member (4, 120).

16. A method of lifting a spider (200) for a gyratory crusher comprising:

providing the lifting apparatus (100) according to any one of the preceding claims above a spider (200);

lowering the lifting apparatus (100) so that the leg members (120) straddle side portions of the spider (200);

turning the lifting apparatus (100) approximately 90 degrees in a direction (B) of rotation about the vertical axis (A) such that the lifting apparatus (100) cradles the spider (200) from below the spider (200) and supports the spider (200) at a support surface (34,127) atop each cradle arm (27,121*c*); and lifting the spider (200) by raising the lifting apparatus (100).

17. The method according to claim 16, wherein the step of lifting the spider (200) by raising the lifting apparatus (100) comprises raising a tensile member attached to the tether receiving portion (36,113) of the lifting apparatus (100).

18. The method according to claim 16 or 17 wherein the method comprises removing the spider (100) from a gyratory crusher.

19. The method according to any one of preceding claims 16-18 further comprising lowering the spider (200) onto a gyratory crusher.

* * * * *